US005609420A

United States Patent [19]

Palmisano

[11] Patent Number: 5,609,420

[45] Date of Patent: Mar. 11, 1997

[54] RECLOSABLE BAG CLOSURE WITH TEAR CONTAINING STRIPS

[75] Inventor: Andrew J. Palmisano, Peotone, Ill.

[73] Assignee: Minigrip, Inc., Orangeburg, N.Y.

[21] Appl. No.: 675,725

[22] Filed: Jul. 3, 1996

Related U.S. Application Data

[63] Continuation of Ser. No. 252,187, Jun. 1, 1994, abandoned.

[51] Int. Cl.[6] ..... B65D 33/02

[52] U.S. Cl. ..... 383/203; 383/61; 383/63; 383/206

[58] Field of Search ..... 383/5, 61, 63, 383/203, 204, 205, 206

[56] References Cited

U.S. PATENT DOCUMENTS

| | | | |
|---|---|---|---|
| 3,780,781 | 12/1973 | Uramoto | 383/61 X |
| 5,121,997 | 6/1992 | La Pierre et al. | 383/203 |
| 5,186,543 | 2/1993 | Cochran | 383/206 X |
| 5,242,516 | 9/1993 | Custer et al. | 383/63 X |

FOREIGN PATENT DOCUMENTS

| | | | |
|---|---|---|---|
| 0547966 | 6/1993 | European Pat. Off. | 383/61 |
| 0226556 | 9/1989 | Japan | 383/61 |
| 0205559 | 8/1990 | Japan | 383/206 |

*Primary Examiner*—Jes F. Pascua

*Attorney, Agent, or Firm*—Kane, Dalsimer, Sullivan, Kurucz, Levy, Eisele and Richard, LLP

[57] ABSTRACT

A package closure for such packages as reclosable plastic bags includes male and female interlocking profiles and a tear bead on one side of a zipper tape film. On the other side of the zipper tape film are two tear containing strips, preferably of ethylene vinyl acetate. In use, the zipper tape film is in a folded condition with male and female profiles interlocked. This places the tear containing strips on opposite sides of the outside of the folded zipper tape film, where they cooperate in serving to seal and bond packaging film to the zipper tape film, and to prevent the tear formed when the package is initially opened from running to the profiles.

8 Claims, 4 Drawing Sheets

RECLOSABLE BAG CLOSURE WITH TEAR CONTAINING STRIPS

This is a continuation, of copending application Ser. No. 08/252,187, filed Jun. 1, 1994, now abandoned.

BACKGROUND OF THE INVENTION

1. Field of The Invention

This invention pertains to the art of closures for reclosable plastic bags having extruded zippers, and more particularly to a sealed reclosable bag in which goods may be sold to consumers in retail outlets. The bags in question are provided with tear containing strips which cooperate in sealing the packaging film to the zipper tape film outwardly from the zipper profiles, and which prevent a tear formed across the top of the package when the bag is first opened from running to the profiles.

2. Description of the Prior Art

Reclosable bags containing and displaying goods, particularly foodstuffs, for sale in retail outlets are known in the art. Typically, bags of this type must be provided with means which would reveal an earlier opening, deliberate or accidental, of the bag to a prospective purchaser. Peel seals outward of the zipper profiles of a reclosable plastic bag, are commonly used for this purpose. By its nature, a peal seal, once broken, cannot be resealed. Upon inspection, then, a prospective purchaser may readily learn whether a bag of this type has been previously opened.

Reclosable plastic bags may also be provided with tear beads. When grasped and torn away, a tear bead will permit access to the contents of the bag by allowing its interlocked zipper profiles to be separated from outside the bag. Of course, once the tear bead has been torn away, it is quite clear that the reclosable plastic bag may have been opened. To the prospective purchaser, this is warning enough to search for another bag containing the desired commodity and having its tear bead intact.

The present invention concerns reclosable plastic bags of this latter type. A problem encountered with such bags has been that, in removing the top of the package by ripping at the tear bead, the run sometimes meanders down the package (instead of straight across). This could render the package useless since the zipper could no longer close the bag.

The present invention represents a long-sought solution to this problem in prior-art reclosable plastic bags.

SUMMARY OF THE INVENTION

Accordingly, the present invention is a package closure for a polymeric resin film package which comprises a zipper tape film of a polymeric resin material. The zipper tape film has two sides, two lateral edges and a center line halfway between the two lateral edges.

On one side of the zipper tape film, a tear bead and two base strips are extruded. The tear bead may be of low density polyethylene, and is substantially adjacent to the center line of the zipper tape film. The base strips, applied substantially equidistantly on either side of the center line, are of a polymeric resin material permitting a male profile and a female profile to be bonded to the zipper tape film. The base strips may be of ethylene vinyl acetate, and the male and female profiles may be of low density polyethylene. The ethylene vinyl acetate permits the low density polyethylene to be bonded to the zipper tape film.

On the other side of the zipper tape film, two tear containing strips are provided, one on either side of the center line thereof. The tear containing strips may also be of ethylene vinyl acetate and serve as a means for stopping the run of the tear bead when the package is opened and may also bind the zipper tape film to the film from which the package itself is made.

In use, the zipper tape film is folded at the center line so that the male and female profiles interlock with one another. The tear bead is, as a consequence, disposed within the fold. The tear containing strips are on opposite sides of the outside of the folded zipper tape film. Packaging film is bonded to the zipper tape film. Subsequently, when the package is to be opened by tearing away the tear bead, the tear containing strips prevent the tear from running to the profiles or below.

The present invention will now be described in more complete detail below with reference being made to the figures, which may be identified as follows.

DETAILED DESCRIPTION OF THE PREFERRED EMBODIMENT

Figure 1:
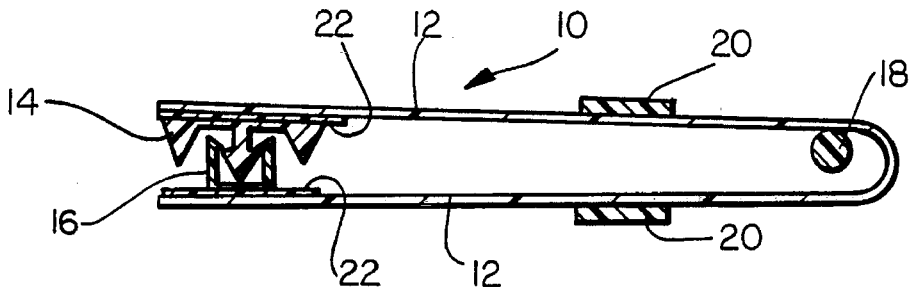
FIG. 1 is a cross-sectional view of the zipper tape film of the present invention.

Referring now specifically to the figures, FIG. 1 is a cross-sectional view of the zipper tape film 10 of the present invention. The zipper tape film 10 includes a zipper tape film 12 of a polymeric resin material such as low density polyethylene. The zipper tape film 12, for purposes of illustration, is shown in a folded condition, so that the male profile 14 and female profile 16 attached thereto may be shown in an interlocked condition. Profiles comprising interlocking rib and groove members may be used in the present invention as well as those shown in FIG. 1.

A tear bead 18, which may also be of low density polyethylene (LDPE) is extruded during the production of the zipper tape film 10 at a position that will be within the fold substantially adjacent to the crease at the center line of the zipper tape film 12. Further, at points between the tear bead 18 and the male and female profiles 14,16 on each side of the outside of the folded zipper tape film 12, a tear containing strip 20, which may be of ethylene vinyl acetate (EVA), is extruded. The function of the tear containing strips 20 is two-fold. As will be illustrated below, the tear containing strips 20 cooperate in bonding the zipper tape film 12 to the packaging film. At the same time, and as a consequence, the tear containing strips 20 prevent the run of the tear from extending below them into the profile area when the package is first opened.

The male profile 14 and female profile 16 may, like the tear bead 18, be extruded from a low density polyethylene (LDPE). To improve the bond between the male profile 14 and the female profile 16 with the zipper tape film 12, base strips 22, which may also be of ethylene vinyl acetate (EVA), may be applied to the zipper tape film 12 and the male profile 14 and female profile 16 extruded onto the base strips 22.

Figure 2:
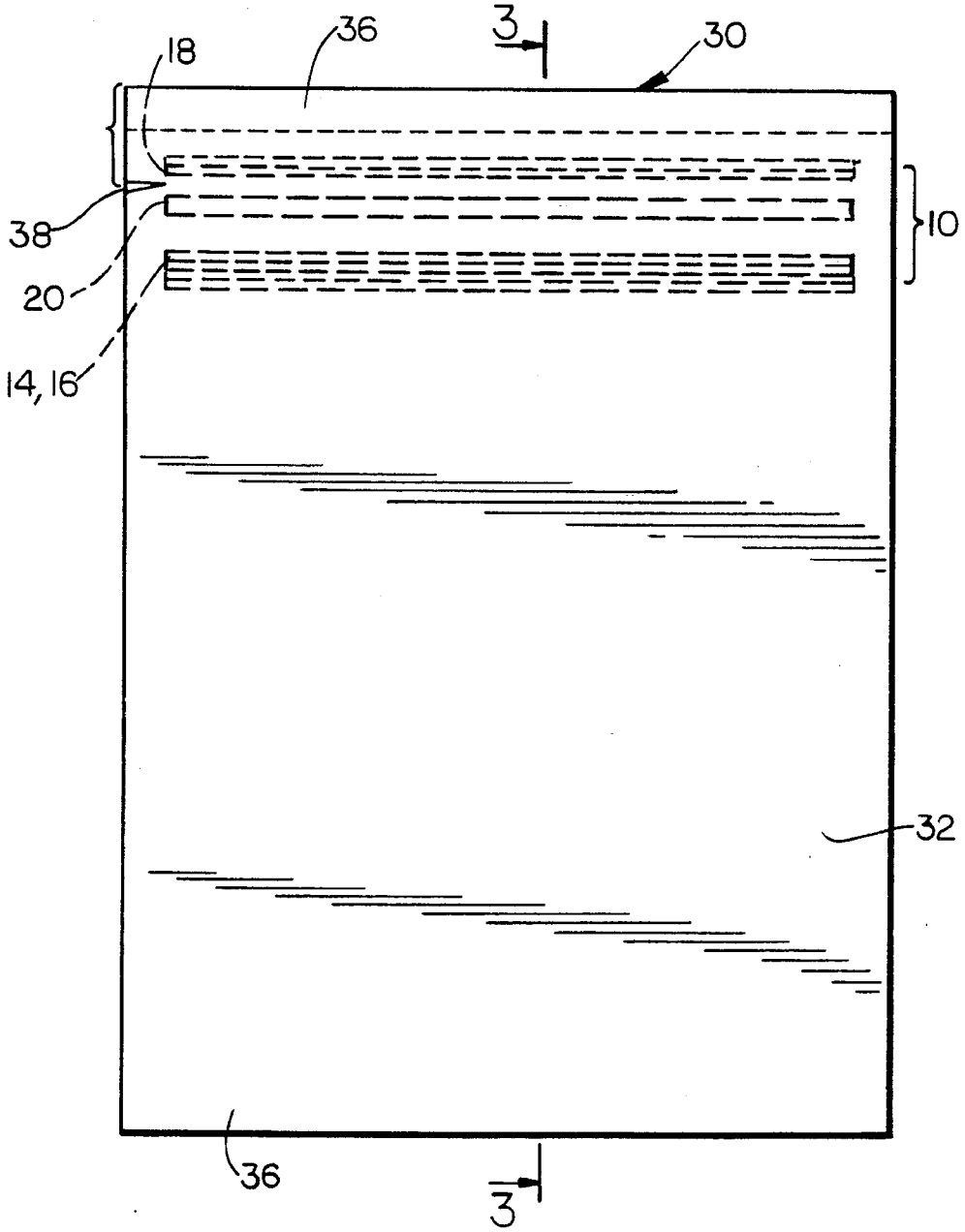
FIG. 2 is a plan view of a package of the variety in which the present invention may be included.

A plan view of a package 30, shown to be a bag without implying that the present invention is exclusively used in that type of package, in which the zipper tape film 10 may be included as provided in FIG. 2. The package 30 comprises a front packaging film 32 and a back packaging film 34 (not shown in FIG. 2) bonded and sealed to one another around the edges 36. Preferably, a notch 38 is made in the edge 36 at a point between the tear bead 18 and the tear containing strips 20 of zipper tape film 10 on at least one of the two sides of the package 30. The notch 38 provides a starting point for tearing away that strip 40 of the package 30 above the tear bead 18 to open the package 30.

Figure 3:
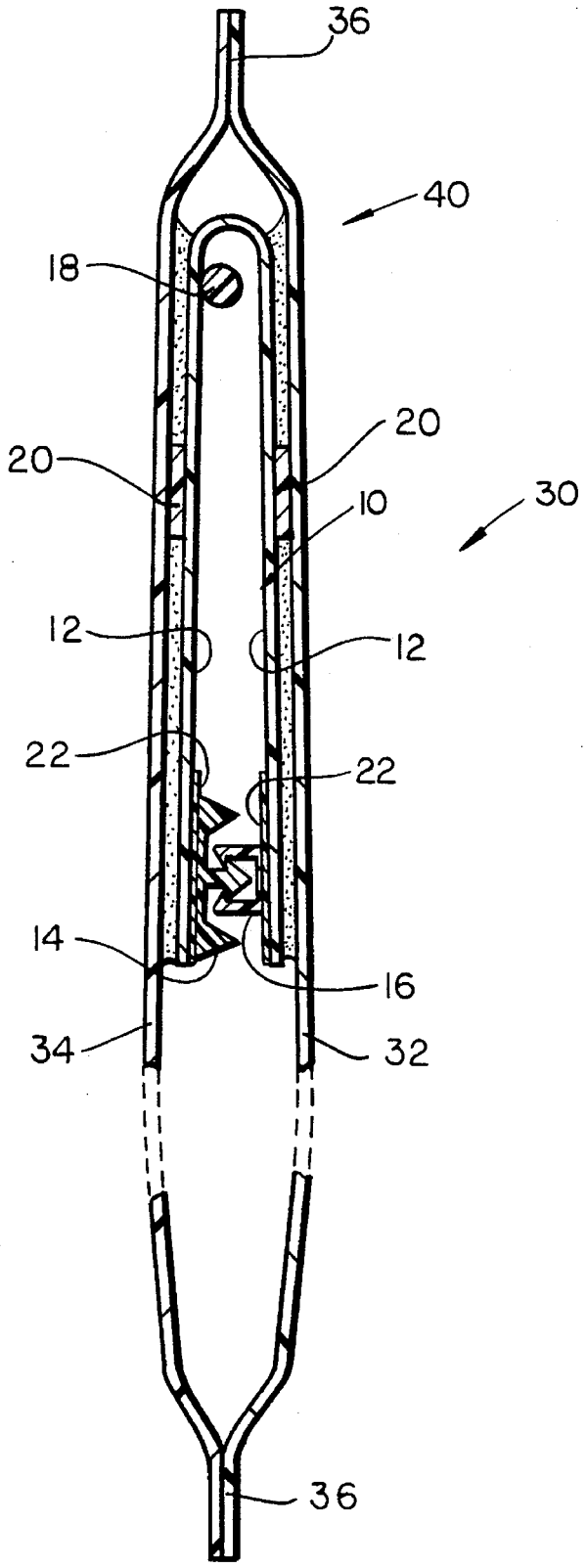
FIG. 3 is a cross-sectional view, taken as indicated by line 3—3 in FIG. 2, of the package shown therein.

FIG. 3 is a cross-sectional view of the package 30 taken as indicated by line 3—3 in FIG. 2. As shown, the zipper tape film is sealed to the front packaging film 32 and the rear packaging film 34 by welds or other bonding techniques in a conventional manner above and below the tear containing strips 20 and also by the tear containing strips. That is, in sealing the zipper tape film 10 to the film forming the package walls, the tear containing strips are also sealed to the package film. For this reason EVA is chosen for the tear containing strips 20 since the EVA strips will fuse to the film 32,34 of the package walls at temperatures at or below the temperature required to fuse the zipper tape 12 to the package wall. When strip 40, that portion of the package 30 including the tear bead 18 and above the horizontal dashed line in FIG. 2, is torn away to open the package 30, the tear containing strips 20, which bond and seal the zipper tape film 12 to the front packaging film 32 and the back packaging film 34, prevent the tear caused by pulling the tear bead from running to the profiles. That is, any downwardly directed tear would stop at the tear containing strip.

Figure 4:
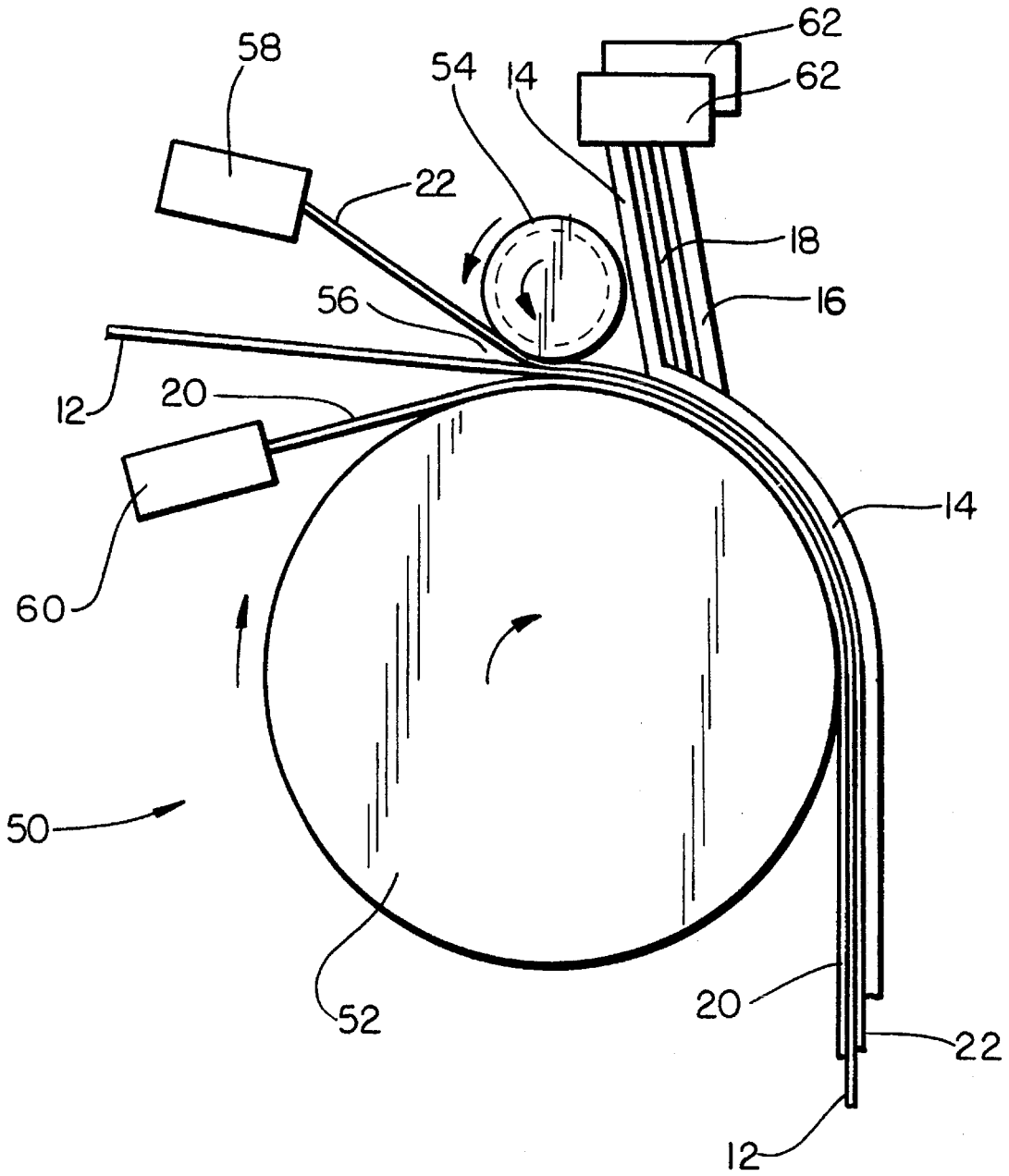
FIG. 4 is a side view of an apparatus used to manufacture the zipper tape film of the present invention.

FIG. 4 is a side view of an apparatus 50 for manufacturing the zipper tape film 10 of the present invention. The apparatus 40 includes a first roller 52 and a second roller 54, which are adjacent to one another and form a nip 56 therebetween. Zipper tape film 12, in a planar rather than a folded condition, is directed toward the nip 56. Two base strips 22 are extruded onto one side of the zipper tape film 12 by extruder 58, while two tear containing strips 20 are extruded onto the other by extruder 60. In passing through nip 56, the base strips 22 and the tear containing strips 20 are flattened against the two (opposite) sides of the zipper tape film 12. In this connection, roller 54 is provided with a recess, as shown, in the area where the tear retard strips have been cast to accommodate the difference in thickness between the tear retard strips and the bases which bond the profiles to the film.

Upon exit from the nip 56, a male profile 14 is extruded onto one of the two base strips 22, a female profile 16 is extruded onto the other base strip 22, and a tear bead 18 is extruded onto the zipper tape film 12 in the space between the two base strips 22 by extruders 62.

Figure 5:
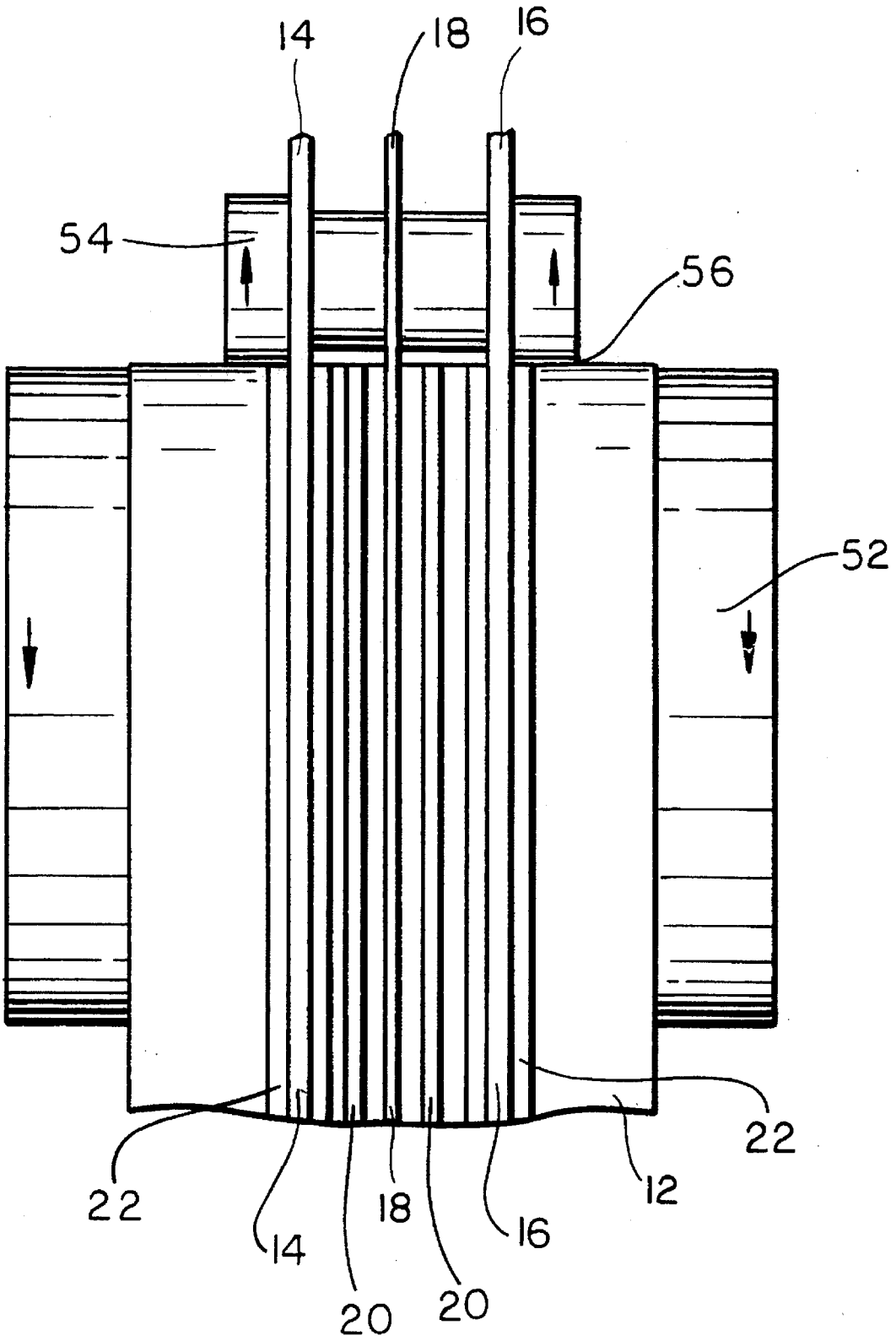
FIG. 5 is a fragmentary view of the same apparatus taken from the right side of that shown in FIG. 4.

FIG. 5 is a view of apparatus 50 taken from the right side of that shown in FIG. 4. Zipper tape film 12, having two base strips 22 flattened thereagainst on one side (the side facing the viewer of FIG. 5), and two tear containing strips 20 flattened thereagainst on the other side, emerges from the nip 56 formed by the first roller 52 and the second roller 54. The male profile 14 is extruded onto one of the base strips 22, while the female profile 16 is extruded onto the other base strip 22. The tear bead 18 is applied directly to the zipper tape film 12 between the male profile 14 and the female profile 16.

Modifications to the above would be obvious to anyone skilled in the art, but would not bring the zipper tape film so modified beyond the scope of the appended claims.

What is claimed is:

1. A polymeric resin film package comprising:

a front package film;

a rear package film;

a zipper tape film of a first polymeric resin material, said zipper tape film having a first surface and a second surface, two lateral edges, and a center line halfway between said two lateral edges;

a tear bead on said first surface of said zipper tape film, said tear bead being attached to said zipper tape film substantially adjacent to said center line thereof;

a male profile on said zipper tape first surface on one side of said center line;

a female profile on said zipper tape first surface on an opposite side of said center line;

a first tear containing strip of a second polymeric material and a second tear containing strip of said second polymeric material on said second surface of said zipper tape film, said first tear containing strip being disposed between said male profile and said tear bead and said second tear containing strip being disposed between said female profile and said tear bead; and, means, including said first and second tear containing strips, for bonding said second surface of said zipper tape film to said front package film and said rear package film.

2. A package as claimed in claim 1 further comprising a first base strip and a second base strip on said first surface of said zipper tape film, said first base strip and said second base strip being of a polymeric resin material and being attached to said zipper tape film on opposite sides of and substantially equidistant from said tear bead, and said male profile is attached to said first base strip and said female profile is attached to said second base strip.

3. A package in accordance with claim 1 wherein said bonding means includes fusing portions of said zipper tape film second surface on opposite sides of said first tear containing strip to said front package film and fusing portions of said zipper tape film second surface on opposite sides of said second tear containing strip to said rear package film.

4. A package as claimed in claim 1 wherein said polymeric resin material of said tear bead is low density polyethylene.

5. A package as claimed in claim 2 wherein said polymeric resin material of said first and second base strips is ethylene vinyl acetate (EVA).

6. A package as claimed in claim 1 wherein said polymeric resin material of said male and female profiles is low density polyethylene.

7. A package as claimed in claim 1 wherein said polymeric resin material of said first and second tear containing strips is ethylene vinyl acetate (EVA).

8. A package as claimed in claim 1 wherein said polymeric resin material of said zipper tape film is low density polyethylene.

* * * * *